US011858032B2

(12) United States Patent
Zhou

(10) Patent No.: US 11,858,032 B2
(45) Date of Patent: Jan. 2, 2024

(54) HIGH-TEMPERATURE ALLOY PRESSURE CASTING MOLD AND CASTING PROCESS FOR IMPELLER AND GUIDE VANE

(71) Applicant: SHANGHAI CHANGQIANG INDUSTRIAL TECHNOLOGY LIMITED COMPANY, Shanghai (CN)

(72) Inventor: Juming Zhou, Shanghai (CN)

(73) Assignee: SHANGHAI CHANGQIANG INDUSTRIAL TECHNOLOGY LIMITED COMPANY, Shanghai (CN)

( * ) Notice: Subject to any disclaimer, the term of this patent is extended or adjusted under 35 U.S.C. 154(b) by 97 days.

(21) Appl. No.: 17/596,174

(22) PCT Filed: Jun. 4, 2019

(86) PCT No.: PCT/CN2019/089968

§ 371 (c)(1),
(2) Date: Dec. 3, 2021

(87) PCT Pub. No.: WO2020/243900

PCT Pub. Date: Dec. 10, 2020

(65) Prior Publication Data

US 2022/0241848 A1 Aug. 4, 2022

(30) Foreign Application Priority Data

Jun. 3, 2019 (CN) ..... 201910475916.5

(51) Int. Cl.
*B22D 17/22* (2006.01)
*B22C 9/06* (2006.01)
*B22C 9/20* (2006.01)

(52) U.S. Cl.
CPC ..... *B22C 9/20* (2013.01); *B22C 9/065* (2013.01); *B22D 17/2218* (2013.01)

(58) Field of Classification Search
CPC .... B22D 17/00; B22D 17/22; B22D 17/2218; B22C 9/06; B22C 9/20
(Continued)

(56) References Cited

U.S. PATENT DOCUMENTS 2,454,961 A * 11/1948 Booth ..... B22D 17/04 164/440
5,454,416 A * 10/1995 Ota et al. ..... B22D 18/06 164/319

FOREIGN PATENT DOCUMENTS

CN 1947893 A 4/2007
CN 204975216 U 1/2016
(Continued)

OTHER PUBLICATIONS

International Search Report of PCT/CN2019/089968, dated Mar. 5, 2020, 6 pages including English translation.

*Primary Examiner* — Kevin P Kerns
(74) *Attorney, Agent, or Firm* — Hamre, Schumann, Mueller & Larson, P.C.

(57) ABSTRACT

Disclosed is a high-temperature alloy pressure casting mold for an impeller and a guide vane. The high-temperature alloy pressure casting mold includes a casting main pipe, a lower casting pipe, and forming steel mold assemblies, wherein the plurality of forming steel mold assemblies surround the casting main pipe, the casting main pipe is provided with a pressure device, the bottom of the casting main pipe is connected to a casting gate at the bottom of each forming steel mold assembly by means of the lower casting pipe, and casting is carried out using pressure supplied by the main pipe. Further disclosed is a high-temperature alloy pressure casting process for an impeller and a guide vane using the casting mold.

4 Claims, 2 Drawing Sheets

(58) Field of Classification Search
USPC ..... 164/113, 284, 303
See application file for complete search history.

(56) References Cited

FOREIGN PATENT DOCUMENTS

| | | | |
|---|---|---|---|
| CN | 206435732 | U | 8/2017 |
| CN | 208303790 | U | 1/2019 |
| JP | S60-187447 | A | 9/1985 |

* cited by examiner

HIGH-TEMPERATURE ALLOY PRESSURE CASTING MOLD AND CASTING PROCESS FOR IMPELLER AND GUIDE VANE

TECHNICAL FIELD

The present invention relates to the field of casting, in particular to a high-temperature alloy pressure casting mold and a casting process for impellers and guide vanes.

BACKGROUND

Impellers and guide vanes of traditional pumps and valves are made by precision lost-wax casting process. Although the precision lost-wax casting process solves the problem of complex product shape, castings manufactured by the process have the following disadvantages: 1. too many risers and low process yield cause difficult to effectively control cost; 2. the problem of shrinkage cavities can not be effectively solved, causing difficult to guarantee casting quality; and 3. only one finished casting can be formed at a time.

The castings made by the precision lost-wax casting process have many risers, which need riser self-weight liquid steel pressure much heavier than the castings themselves to feed shrinkage cavities. As a result, the same weight of liquid steel can only produce a small number of castings, and the cost is difficult to be effectively controlled. Take double-suction impellers of KSB, Germany as an example, the weight of OMEGA 200 casting is 67.85 kg, the weight of the riser is 110.27 kg, and the total weight is 178.12 kg. Therefore, 1425 kg liquid steel can form only 8 finished double-suction impellers. It is estimated that the process yield of the precision lost-wax casting process is about 40%, and the waste material is about 60%.

The shrinkage cavity of the casting made by the precision lost-wax casting process needs to be fed with the riser self-weight liquid steel pressure much heavier than the casting itself, but the feeding effect is not ideal, the problem cannot be effectively solved, and repair welding is needed. As a result, it is difficult to guarantee casting product quality. Therefore, in some areas with high requirements for the casting product quality, such as nuclear power, the precision lost-wax casting process is not a satisfactory process for making finished castings.

Due to limitation of mold structure and technological process, only one finished casting can be formed by the precision lost-wax casting process at a time, resulting in low production efficiency. Take the double-suction impellers of KSB, Germany as an example, totally 1425 kg liquid steel needs to be cast in 8 times, which is time-consuming and laborious.

In addition, common casting molds are generally all-steel molds, and steel molds generally adapt to a temperature range of 1100° C.-1300° C. Any casting temperature above 1400° C. will result in melting of the steel molds. A casting material of impellers and guide vanes are stainless steel which has a melting point of stainless steel of 1450° C., and an actual casting temperature of 1520° C. In addition, the impellers and the guide vanes have extremely complex inner cavity shapes. Therefore, the common all-steel casting mold can not be used for casting the impellers and the guide vanes.

Therefore, it is necessary to design a high-temperature alloy pressure casting mold and a casting process for impellers and guide vanes to adapt to high-temperature casting above 1400° C., reduce risers and shrinkage cavities, improve casting quality, improve process yield and production efficiency and reduce cost.

SUMMARY

The object of the present invention is to overcome the shortcomings of the prior art and provide a high-temperature alloy pressure casting mold and a casting process for impellers and guide vanes so as to adapt to high-temperature alloy casting above 1400° C., reduce risers and shrinkage cavities, improve casting quality, improve process yield and production efficiency, and reduce cost.

In order to attain the object, the present invention provides a high-temperature alloy pressure casting mold for impellers and guide vanes. The high-temperature alloy pressure casting mold comprises a casting main pipe, a lower casting pipe and forming steel mold assemblies, and is characterized in that a plurality of forming steel mold assemblies surround the casting main pipe, the casting main pipe is provided with a pressure device, the bottom of the casting main pipe is connected to a casting gate at the bottom of each forming steel mold assembly by means of the lower casting pipe, the casting main pipe comprises a steel jacket and a ceramic layer, the ceramic layer is attached to an inner surface of the steel jacket, the lower casting pipe comprises a steel pipe and a ceramic pipe, and the steel pipe is sheathed outside the ceramic pipe.

A volume of the casting gate is greater than a local volume of any part of an impeller and guide vane casting.

The forming steel mold assembly comprises a plurality of forming steel molds, the forming steel mold comprises an upper steel mold, a lower steel mold and a core, surfaces of the upper steel mold and the lower steel mold are coated with a zircon powder coating, and the upper steel mold and the lower steel mold are internally provided with the core.

The forming steel mold is provided with a cooling water circulation pipe.

The core is internally provided with a metal support.

The pressure device is a pressure column located on the top of the casting main pipe.

A high-temperature alloy pressure casting process for impellers and guide vanes, is characterized in that an impeller and guide vane casting is prepared according to the following steps: step 1: injecting liquid steel into the casting main pipe in the middle of the mold, keeping metal inclusions in the liquid steel suspending on a liquid surface of the liquid steel, and maintaining a height difference between the liquid surface of the liquid steel and the top of an inner surface of the forming steel mold at 120 mm-400 mm; step 2: pressurizing the casting main pipe so that the liquid steel in the casting main pipe flows into the lower casting pipe and flows into each forming steel mold from bottom to top through the casting gate; step 3: transferring the pressure obtained by the casting main pipe to the liquid steel in the forming steel mold by liquid during crystallization of the liquid steel in the forming steel mold, so that the liquid steel fills an inner cavity of the forming steel mold; step 4: waiting 3-5 min to allow the liquid steel in the forming steel mold to crystallize and form the impeller and guide vane casting, with the liquid steel at the casting gate being in liquid state; step 5: filling shrinkage cavities with the liquid steel at the casting gate to form risers; and step 6: cooling and demolding the impeller and guide vane casting.

When a casting temperature of the liquid steel is 1470° C.-1520° C. and a weight of the liquid steel is 1420 kg, totally 18 impeller and guide vane castings are formed.

A process of pressurizing the casting main pipe is to increase the pressure from 100 kg to 10000 kg at a constant speed in 3-4 min.

During the crystallization of the liquid steel in the forming steel mold, water cooling is carried out.

Compared with the prior art, by means of improvement of the mold structure, the casting mold can adapt to high-temperature alloy casting above 1400° C., realize the forming of multiple sets of impellers and guide vanes at a time, and improve the production efficiency. The pressure supply design of the pressure casting main pipe reduces risers and shrinkage cavities, improves the casting quality, improves the process yield, and reduces the production cost.

DETAILED DESCRIPTION

The present invention is further described in conjunction with the drawings.

Figure 1:
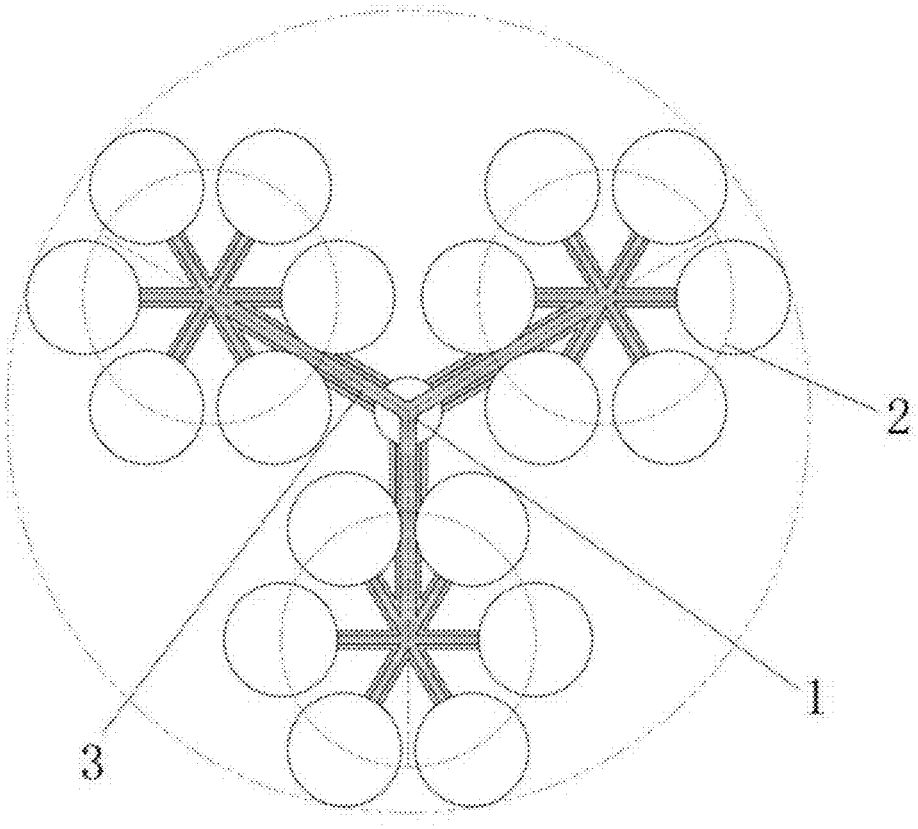
FIG. 1 shows a schematic diagram of the present invention.
Figure 2:
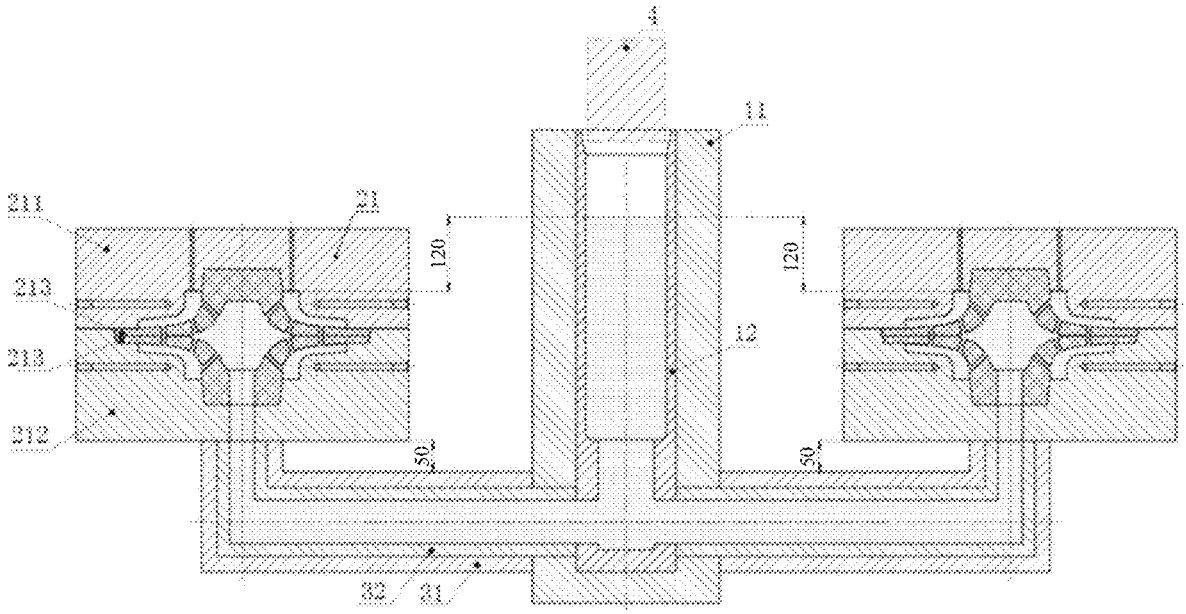
FIG. 2 shows a schematic sectional view of the present invention.

Referring to FIG. 1 and FIG. 2, the present invention provides a high-temperature alloy pressure casting mold for impellers and guide vanes. The high-temperature alloy pressure casting mold comprises a casting main pipe, a lower casting pipe and forming steel mold assemblies; and a plurality of forming steel mold assemblies 2 surround the casting main pipe 1, the casting main pipe 1 is provided with a pressure device, the bottom of the casting main pipe 1 is connected to a casting gate at the bottom of each forming steel mold assembly 2 by means of the lower casting pipe 3, the casting main pipe 1 comprises a steel jacket 11 and a ceramic layer 12, the ceramic layer 12 is attached to an inner surface of the steel jacket 11, the lower casting pipe 3 comprises a steel pipe 31 and a ceramic pipe 32, and the steel pipe 31 is sheathed outside the ceramic pipe 32.

In the present invention, a volume Φ of the casting gate is 130×400 $mm^3$, a maximum wall thickness of an impeller and guide vane casting is 51 mm, and the volume of the casting gate is greater than a local volume of any part of the impeller and guide vane casting. Liquid steel at the casting gate has a temperature always higher than that of the impeller and guide vane casting during casting, so that the pressure can be transmitted by liquid until all inner parts of the impeller and guide vane casting are crystallized.

In the present invention, the forming steel mold assembly 2 comprises a plurality of forming steel molds 21, the forming steel mold 21 comprises an upper steel mold 211, a lower steel mold 212 and a core 213, surfaces of the upper steel mold 211 and the lower steel mold 212 are coated with a zircon powder coating, and the upper steel mold 211 and the lower steel mold 212 are internally provided with the core 213. Taking 18 impeller and guide vane castings as an example, there are three forming steel mold assemblies 2 and six formed steel molds 21. In order to facilitate rapid cooling, a cooling water circulation pipe is provided on the forming steel mold 21. The core 213 is internally provided with a metal support which plays a supporting role and can be used repeatedly. The pressure device is a pressure column 4 located on the top of the casting main pipe 1.

A high-temperature alloy pressure casting process for impellers and guide vanes is used for preparing an impeller and guide vane casting according to the following steps: step 1: injecting liquid steel into the casting main pipe in the middle of the mold at a casting temperature of 1470° C.-1520° C., keeping metal inclusions in the liquid steel suspending on a liquid surface of the liquid steel instead of entering the forming steel molds 21, and maintaining a height difference between the liquid surface of the liquid steel and the top of an inner surface of the forming steel mold at 120 mm-400 mm to enable the liquid steel to be injected into the forming steel molds faster;

Step 2: pressurizing the casting main pipe so that the liquid steel in the casting main pipe flows into the lower casting pipe and flows into each forming steel mold from bottom to top through the casting gate; and a process of pressurizing the casting main pipe is to increase the pressure from 100 kg to 10000 kg at a constant speed in 3-4 min so as to reduce the weight of the riser, ensure that metal cutting surface layer inside the casting has no shrinkage cavity, eliminate the need of repair welding of the impeller and guide vane casting, and improve the casting quality to meet the needs of various industries;

Step 3: transferring the pressure obtained by the casting main pipe to the liquid steel in the forming steel mold by liquid during crystallization of the liquid steel in the forming steel mold, so that the liquid steel fills an inner cavity of the forming steel mold; during the crystallization of the liquid steel in the forming steel mold, water cooling can be carried out; and when the temperature of the core drops to 1300° C., the core can be subject to water cooling so as to improve production capacity and protect the mold;

Step 4: waiting 3-5 min to allow the liquid steel in the forming steel mold to crystallize and form the impeller and guide vane casting, with the liquid steel at the casting gate being in liquid state;

Step 5: filling shrinkage cavities with the liquid steel at the casting gate to form risers; and Step 6: cooling and demolding the impeller and guide vane casting. When the weight of the liquid steel is 1420 kg, totally 18 impeller and guide vane castings are formed.

According to test, the present invention began to produce 28 ml shrinkage cavities at 26 s after casting, and produced a total of 760 shrinkage cavities with a total weight of about 527 g after 3 min. The volume Φ of the casting gate is 130×400 $m^3$, and the liquid steel at the casting gate is about 37 kg. The total liquid steel required for feeding the shrinkage cavities of 18 impeller and guide vane castings is 527 g×18 (about 9.5 kg), which greatly reduces the weight of the riser, thus improving the process yield to more than 85%.

The provision of the ceramic layer 12, the ceramic pipe 32 and zircon powder coating enable the casting mold to adapt to the high-temperature alloy casting above 1400° C. The present invention can realize the forming of 18 impellers and guide vanes at a time, which improves the production efficiency. The pressure supply design of the pressure casting main pipe reduces risers and shrinkage cavities, improves the casting quality, improves the process yield to more than 85%, and reduces the production cost.

What is claimed is:

1. A high-temperature alloy pressure casting process for casting of impellers and guide vanes, the high-temperature alloy pressure casting process comprising:

injecting liquid steel into a casting main pipe in a middle of the mold, keeping metal inclusions in the liquid steel suspended on a liquid surface of the liquid steel, and maintaining a height difference between the liquid surface of the liquid steel and the top of an inner surface of a forming steel mold at 120 mm-400 mm;

pressurizing the casting main pipe so that the liquid steel in the casting main pipe flows into a lower casting pipe and flows into each forming steel mold from bottom to top through a casting gate;

transferring pressure obtained by the casting main pipe to the liquid steel in the forming steel mold during crystallization of the liquid steel in the forming steel mold, so that the liquid steel fills an inner cavity of the forming steel mold;

waiting 3-5 minutes to allow the liquid steel in the forming steel mold to crystallize and form the impeller and guide vane casting, with the liquid steel at the casting gate being in a liquid state;

filling shrinkage cavities with the liquid steel at the casting gate to form risers; and cooling and demolding of an impeller and guide vane casting.

2. The high-temperature alloy pressure casting process for casting of impellers and guide vanes according to claim 1, wherein when a casting temperature of the liquid steel is 1470° C.-1520° C. and a weight of the liquid steel is 1420 kg, a total of 18 impeller and guide vane castings are formed.

3. The high-temperature alloy pressure casting process for casting of impellers and guide vanes according to claim 1, wherein a process of pressurizing the casting main pipe is to increase the pressure from 100 kg to 10000 kg at a constant speed in 3-4 min.

4. The high-temperature alloy pressure casting process for casting of impellers and guide vanes according to claim 1, wherein water cooling is carried out during the crystallization of the liquid steel in the forming steel mold.

* * * * *